US006835929B2

(12) United States Patent
Finch

(10) Patent No.: US 6,835,929 B2
(45) Date of Patent: Dec. 28, 2004

(54) COAXIAL ATMOSPHERIC PRESSURE PHOTOIONIZATION SOURCE FOR MASS SPECTROMETERS

(75) Inventor: Jeffrey W. Finch, Mendon, MA (US)

(73) Assignee: Waters Investments Limited, New Castle, DE (US)

( * ) Notice: Subject to any disclaimer, the term of this patent is extended or adjusted under 35 U.S.C. 154(b) by 0 days.

(21) Appl. No.: 10/351,696

(22) Filed: Jan. 27, 2003

(65) Prior Publication Data

US 2003/0234368 A1 Dec. 25, 2003

Related U.S. Application Data

(60) Provisional application No. 60/353,861, filed on Jan. 25, 2002.

(51) Int. Cl.[7] ..... H01V 49/28

(52) U.S. Cl. ..... 250/288; 250/289; 250/293

(58) Field of Search ..... 250/288, 289, 250/293, 299

(56) References Cited

U.S. PATENT DOCUMENTS

| | | | | |
|---|---|---|---|---|
| 5,808,299 A | | 9/1998 | Syage | 250/288 |
| 6,211,516 B1 | | 4/2001 | Syage et al. | 250/288 |
| 6,534,765 B1 | * | 3/2003 | Robb et al. | 250/288 |
| 6,646,256 B2 | * | 11/2003 | Gourley et al. | 250/288 |

FOREIGN PATENT DOCUMENTS

WO WO 01/33605 10/2002

OTHER PUBLICATIONS

1990 DIssertation submitted to the University of Arizona, Department of Chemistry entitled: A Krypton VUV Photoionization Source For Gas Chromatography And Mass Spectrometry. Arthur: Mark Eugene Homan.

Proceedings of the 49$^{th}$ ASMS Conference on Mass Spectrometry and Allied Topics, Chicago, Illinois, May 27–31, 2001. Entitled: Mechanisms for ion formation in LC/MS by Atmospheric Pressure Photo–ionization (APPI). By: Grielof Koster and Andries P. Bruins, University Centre for Pharmacy, A. Deusinglaan 1, 9713 AV Groningen, The Netherlands.

Proceedings of the 49$^{th}$ ASMS Conference on Mass Spectrometry and Allied Topics, Chicago, Illinois, May 27–31, 2001. Entitled: Comparative Study: LC–MS/MS Analysis of Four Steriod Compounds Using a New Photoionization Source and a Conventional APCI Source. By: Jean–Francois Alary, Applied Biosystems/MDS SCIEX, 71 Four Valley Drive, Concord, Ontario, Canada L4K 4V8.

Proceedings of the 49$^{th}$ ASMS Conference on Mass Spectrometry and Allied Topics, Chicago, Illinois, May 27–31, 2001. Entitled: Atmospheric Pressure Photionization (APPI™) for LC/MS. By: Karl A. Hanold, Matthew D. Evans, and Jack A. Syage of Syagen Technology, Inc., 1411 Warner Avenue, Tustin, CA 92780 and Steven M. Fischer and Patricia H. Cormia, Agilent Technologies, Inc., 1601 Carlifornia Avenue, Palo Alto, CA 94304.

Reprinted in American Laboratory Dec. 2000, Photoionization Mass Spectrometry. By: Jack A. Syage, Metthew D. Evans and Karl A. Hanold.

* cited by examiner

*Primary Examiner*—John R. Lee
*Assistant Examiner*—Anthony Quash
(74) *Attorney, Agent, or Firm*—Edwards & Angell, LLP; Peter C. Lauro, Esq.; George W. Hartnell, III, Esq.

(57) ABSTRACT

Disclosed herein is a mass spectrometer having an atmospheric pressure photoionization (APPI) source that comprises a discharge lamp coupled to a nebulizer, wherein the nebulizer is at, or near, atmospheric pressure. The discharge lamp curves around the vapor path and this coaxial design offers significant advantages over the prior art such as increased photon flux resulting in increased photoionization efficiency. One of the significant benefits of an increase in photon flux is that absorption of the UV radiation by solvents such as acetonitrile is minimized. The APPI source described herein also facilitates a larger photoionization interaction zone with effluent from the nebulizer, which may be heated. Additionally, no dopant is required in this coaxial APPI system.

31 Claims, 3 Drawing Sheets

COAXIAL ATMOSPHERIC PRESSURE PHOTOIONIZATION SOURCE FOR MASS SPECTROMETERS

CROSS REFERENCE TO RELATED APPLICATIONS

This application claims benefit of U.S. Provisional Application No. 60/353,861 filed Jan. 25, 2002 the content of which is incorporated herein by reference.

STATEMENT ON FEDERALLY SPONSORED RESEARCH

N/A

FIELD OF THE INVENTION

This invention relates generally to mass spectrometry, and in particular to a photoionization source that is coupled to a source of vapor.

BACKGROUND OF THE INVENTION

The application of mass spectroscopy has emerged from the confines of academic laboratories and has entered the commercial market place. Liquid chromatography/mass spectroscopy (LC/MS) is one of the fastest growing segments of analytical instrumentation primarily due to new applications in biotechnology, including the analysis of biopharmaceuticals. LC/MS requires the ionization of some of the molecules to be analyzed. Some ionization methods impart excess energy to the molecules causing fragmentation, which increases the number of different ions to be analyzed. This greater number of ions increases the number of output signals, which makes it harder to interpret the results of the analysis. The high-energy ionization methods are referred to as hard ionization methods.

Electrospray ionization (ESI) and atmospheric pressure chemical ionization (APCI) are two soft ionization methods commonly used for analyzing liquid samples while minimizing fragmentation. These are methods in which the analytes either protonate to form adducts for positive ion mode or deprotonate (or electron attach) for negative ion mode. In addition to ESI and APCI, photoionization and in particular atmospheric photoionization (APPI) is a soft ionization method generally used for analyzing samples from high-flow devices such as the effluent from a liquid chromatograph.

Currently mass spectroscopy systems employing APPI sources have a "side arm" discharge lamp employing, e.g., Kr, wherein the photons are transmitted through a window that is in close proximity to a quartz tube of a heated nebulizer adapted from those used in an APCI system. In this configuration, the photoionization discharge lamp is mounted to the side of the quartz tube of a heated nebulizer from which the corona discharge needle has been removed. A similar system, which positions the discharge lamp at the back of the APCI source housing, and the heated nebulizer probe, without corona discharge needle, is located at right angles to both the discharge lamp window and the inlet for the mass spectrometer. The above systems often infuse a dopant, usually toluene or acetone, into an auxiliary gas line of the heated nebulizer in order to provide chemical ionization as well as the photoionization. This often limits the applicability and advantages observed with photoionization.

In practice, while these APPI systems have the advantage of operating at atmospheric pressure, they have notable disadvantages. For example, acetonitrile, which is an advantageous mobile phase for HPLC separations cannot be used as a mobile phase for prior art APPI LC/MS applications due to acetonitrile's absorption of the UV photons in the relatively small photoionization zone. Another disadvantage, caused in part by the distance between the vapor and the lamp, is the inefficiency of the present direct photoionization of the sample molecule methods. This inefficiency promotes the use of dopant additives such as toluene. Addition of a dopant adds considerable complexity to an MS system. In this type of situation, the dopant is typically more easily photoionized than the molecule of interest. After the photoionization of the dopant, the dopant itself reacts with the molecule of interest in a chemical ionization step, thus rendering the ionization process more like chemical ionization than photoionization.

There is currently a need to have a more efficient photoionization source that can be coupled to a heated nebulizer and perform at, or near, atmospheric pressure. It is desirable to have a mass spectroscopy system that uses a larger photoionization interaction zone with the effluent from a nebulizer. Moreover, a greater photon flux is desired to yield a better photoionization efficiency and sensitivity. Further, it is desirable to have an APPI LC/MS system that has sufficient efficiency that it can accommodate UV-absorbing solvents such as the commonly used acetonitrile. Additionally, it is desirable to have an APPI LC/MS system in which dopants are not required for improving efficient ionization of the molecules of interest.

SUMMARY OF THE INVENTION

The present invention is directed to photoionization source useful with mass spectrometers. The photoionization source comprises a discharge lamp, preferentially formed in a coaxial manner, that is coupled with a vapor source that is at, or near, atmospheric pressure. The vapor source in one embodiment is a nebulizer that is heated to drive the solvents from the vapor. The various gases utilized with the heated nebulizer, i.e. nebulizer gas and coaxial (sometimes called "auxiliary") gas, are typically supplied from a single supply line of nitrogen. While other gases like helium or oxygen could be used, they are not preferred due to excess consumption, expense, and the fact that they will absorb the UV radiation, etc. In addition, any solvent vapor has some potential to absorb the radiation.

In one embodiment, a photoionization source comprises a source of vapor of one or more compounds of interest that causes the vapor to travel in a path defining an axis toward an inlet and a lamp for emitting photons into the vapor path. The lamp has a photon emitting region disposed at a radial distance along the axis, where the axis toward the inlet may be distinct from the centerline of the vapor path. The lamp is in communication with the source of vapor such that the photons are emitted into the vapor traveling on the path producing ionization of the compounds. In some embodiments, the lamp is placed adjacent to the vapor source but is not connected to it. In other embodiments, the lamp is connected to the vapor source by a coupler.

In some configurations, the compounds of interest come into the vapor source from an in-line liquid chromatography apparatus. When a nebulizer is used as the vapor source, it may operate at atmospheric pressure. One or more heating elements capable of heating the nebulizer from about ambient temperature to about 800° C. may be disposed about the nebulizer. The heated nebulizer produces dryer vapor. The nebulizer has a nebulizer tube that is comprised of material selected from the group consisting of quartz, ceramic, fused silica, glass, and stainless steel.

The lamp in the photoionization source may be a discharge lamp. This lamp may have a photon emitting region that subtends an arc of between 90 and 360 degrees about an axis. The lamp then forms an arched passageway for the vapor being ionized. In one embodiment, the photon emitting region encompasses 360 degrees about the lamp axis forming a tube wherein the vapor receives photons from all angles. The lamp contains one or more noble gases that are capable of emitting photons when excited. The excited gases emit photons having energies on the order of from about 7 eV to about 15 eV. One or more of the lamps of the invention may be clustered, radially or longitudinally, to provide a larger ionization region.

In one embodiment, the discharge lamp comprises an ultra-violet transparent tube surrounded by a discharge lamp envelope, that is sealed to the ultra-violet transparent tube, and an Rf discharge coil that is disposed adjacent and external to the lamp envelope. The lamp envelope contains one or more noble gases that are excited, thereby emitting photons, when the Rf discharge coil provides sufficient electrical energy. The ultra-violet transparent tube comprises material selected from the group consisting of quartz, $MgF_2$, $CaF_2$, and LiF and the lamp envelope is made from material selected from the group consisting of glass, soda glass, borosilicate and quartz. A Rf generator drives the Rf discharge coil.

In one embodiment, the centerline of the vapor path and the axis toward the inlet are approximately aligned allowing most of the vapor to pass through the lamp. In another embodiment, the axis is at an angle with respect to the centerline of the vapor path allowing some vapor to be excluded from the excitation path. The vapor source and lamp may be aligned with some space therebetween or may be connected by a connector.

In one embodiment, a mass spectrometer comprises a nebulizer outputting a vapor of one or more components of interest, a lamp for emitting photons into the vapor and a coupler that facilitates the coupling of the nebulizer to the lamp. The vapor travels in a path that defines an axis through the coupled components toward an inlet. The coupler comprises material selected from the group consisting of glass, fused silica, quartz, ceramic, copper, stainless steel, and combinations thereof. The nebulizer further comprises at least one heating element for heating the nebulizer to temperatures between ambient and 800° C. The nebulizer operates at atmospheric pressure.

The lamp has a photon emitting region at a radius along the axis such that photons are emitted into the vapor traveling on the path to produce ionization of the compounds. The photon emitting region is an ultra-violet transparent region. The lamp is charged with one or more noble gases that are capable of emitting photons when excited. In one embodiment, an in-line liquid chromatography apparatus is connected to an input of the nebulizer and the inlet communicates with a mass detector.

In one embodiment, a mass spectrometer comprises an in-line liquid chromatography apparatus connected to a nebulizer operating under atmospheric pressure that outputs a vapor toward a discharge lamp so that the gases in the vapor are excited as they pass through the discharge lamp. The excited gas interacts with a mass detector. The nebulizer may comprise at least one heating element for heating the nebulizer to temperatures between ambient and 800° C. In the discharge lamp, the excited gases emit photons on the order of from about 7 eV to about 15 eV. In one embodiment, the discharge lamp is tube shaped and is approximately aligned along a central axis with the nebulizer. In another embodiment, the central axis of the discharge lamp is at an angle with respect to the central axis of the nebulizer.

In one embodiment of the present invention, a mass spectrometer comprises an APPI source that has a coaxial discharge lamp that is in communication with a nebulizer. In one aspect of this embodiment, the discharge lamp is not structurally integrated with the nebulizer, rather it is disposed adjacent to the nebulizer. In one aspect, the discharge lamp and the nebulizer are aligned along a central axis facilitating the flow of a nebulized gas from the nebulizer to the discharge lamp. In another aspect, the discharge lamp is oriented at an angle to the central axis of the nebulizer allowing nebulized material to enter the discharge lamp while incompletely nebulized material is excluded. One or more heating elements, such as a heating coil, are included in the design of the disclosed APPI source. The heating element(s) provides the nebulizer with heat energy in order to attain the nebulization temperatures of up to 800° C. In one aspect of the invention, the nebulization temperature is optimally between from about ambient temperature to about 400° C. Some compounds will degrade rather than nebulize at higher temperatures, so these lower temperatures are appropriate in such cases. The APPI source of the present invention can be used in combination with an in-line liquid chromatography (LC) apparatus. The effluent from the LC apparatus enters the heated nebulizer, which is under atmospheric pressure. From the heated nebulizer, the effluent proceeds directly into the coaxial discharge lamp region of the APPI source where optimal photoionization occurs. Finally, the ionized sample travels to and is analyzed by a mass detector.

The design of the photoionization source of the instant invention offers significant advantages over the prior art. It produces an increased photon flux, which results in increased photoionization efficiency. Another significant benefit of an increased photon flux is that the effect of absorption of the UV radiation by solvents such as acetonitrile is mitigated. This feature of the present invention permits a practitioner to freely employ commonly used chromatography solvents like acetonitrile in their protocols. Another benefit of the instant invention is that the effluent from a heated nebulizer interacts with a larger photoionization interaction zone. Additionally, a dopant is not necessary in the sample processed by the APPI system of the present invention, however, a dopant could be employed if desired. Moreover, the coaxial design of the photoionization source of the instant invention allows photons from the discharge lamp to penetrate the vapor output from the heated nebulizer from all sides, thus increasing photoionization efficiency. The photoionization source may be placed so that only a portion of the output of the nebulizer enters the source, allowing "wet" vapor to be excluded.

DETAILED DESCRIPTION

Figure 1:
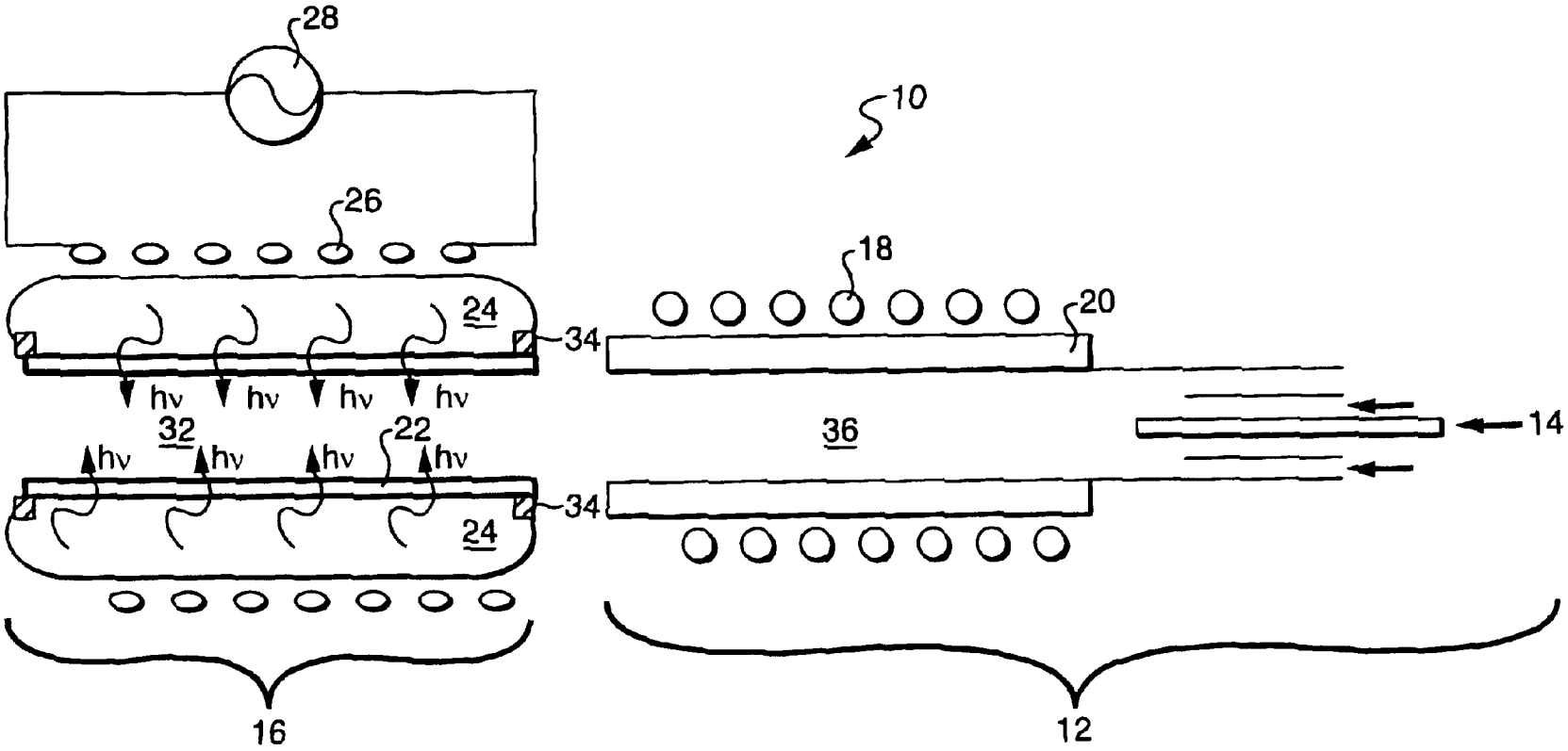
FIG. 1 depicts one embodiment of the present invention in which there is no direct union of a nebulizer to a discharge lamp.

In general, mass spectrometers ionize molecules within a given volume and then accelerate the ionized molecules to a molecular mass detector. Ionization of a molecule can occur through electron-ionization, chemical ionization, electrospray ionization, or photoionization. The ionization process can occur under various pressure conditions, including atmospheric pressure.

The mid-twentieth century witnessed the development and application of the discharge lamp as a potential ultraviolet (UV) radiation source that could extend even into the vacuum-ultra-violet (VUV) range. These lamps typically are charged with a noble gas (He, Ar, Ne, Xe, or Kr) at a certain pressure. A voltage is applied between two electrodes, or a radio-frequency coil is employed, in order to excite the gas to produce photons, which range in energy from 7–15 eV; an energy range well suited for ionizing organic molecules. Generally, a window, made of a suitable material transparent to the photons, such as quartz, $MgF_2$, and the like, is sealed at one end of the lamp in order to transmit photons in the proper wavelength ($\lambda$) range for achieving photoionization of the molecule of interest, the analyte.

ESI and APCI are the two soft ionization methods that have been commonly used for analyzing liquid samples. In these methods the analytes either protonate to form adducts for positive ion mode or deprotonate (or electron attach) for negative ion mode. ESI and APCI are most widely used in LC/MS for analytes, which are polar compounds. While there are cases where ESI and APCI will work for compounds that are considered "nonpolar", these are considered "exceptions" to the general trend. A proven application for discharge lamps is photoionization gas chromatography (GC). Recently photoionization discharge lamps have been used in conjunction with a heated nebulizer for LC/MS applications. Photoionization offers the advantage of being able to produce ions from certain compounds that yield weak or no ion signal with conventional ESI or APCI methods. Steroids, aromatics, phosphonates, phosphonic acids, sulfides, and nonpolar molecules are examples of classes of compounds that may not ionize efficiently using either ESI or APCI.

Although photoionization can also operate at other pressures,atmospheric photoionization (APPI) is discussed herein as one example of photoionization and the teachings of APPI can be applied to other pressures. In APPI, the sample being bombarded with photons from the photoionization source is held at atmospheric pressure, usually maintained by the auxiliary gas environment. APPI is generally used for analyzing samples from high-flow devices such as effluent from a liquid chromatograph. APPI is also commonly used for analyzing non-volatile (generally high-molecular-weight) compounds that require a nebulizer or another type of liquid spray nozzle, whereas in GC/MS, volatile (generally, lower molecular weight) compounds are analyzed. Additionally, the range of compounds amenable to APPI extends across the polarity scale to include nonpolar compounds.

The probability of any analyte being ionized by photoionization depends upon a number of factors, including the ionization potential (IP) and ionization cross-section of the molecule of interest. For example, it is well understood that aromaticity can enhance the likelihood that a molecule can be ionized by interaction with a photon in the range of 7–15 eV. Furthermore, it is generally known that organic molecules that contain tertiary amine functional groups can be ionized with photons in this range of energies.

Figure 2:
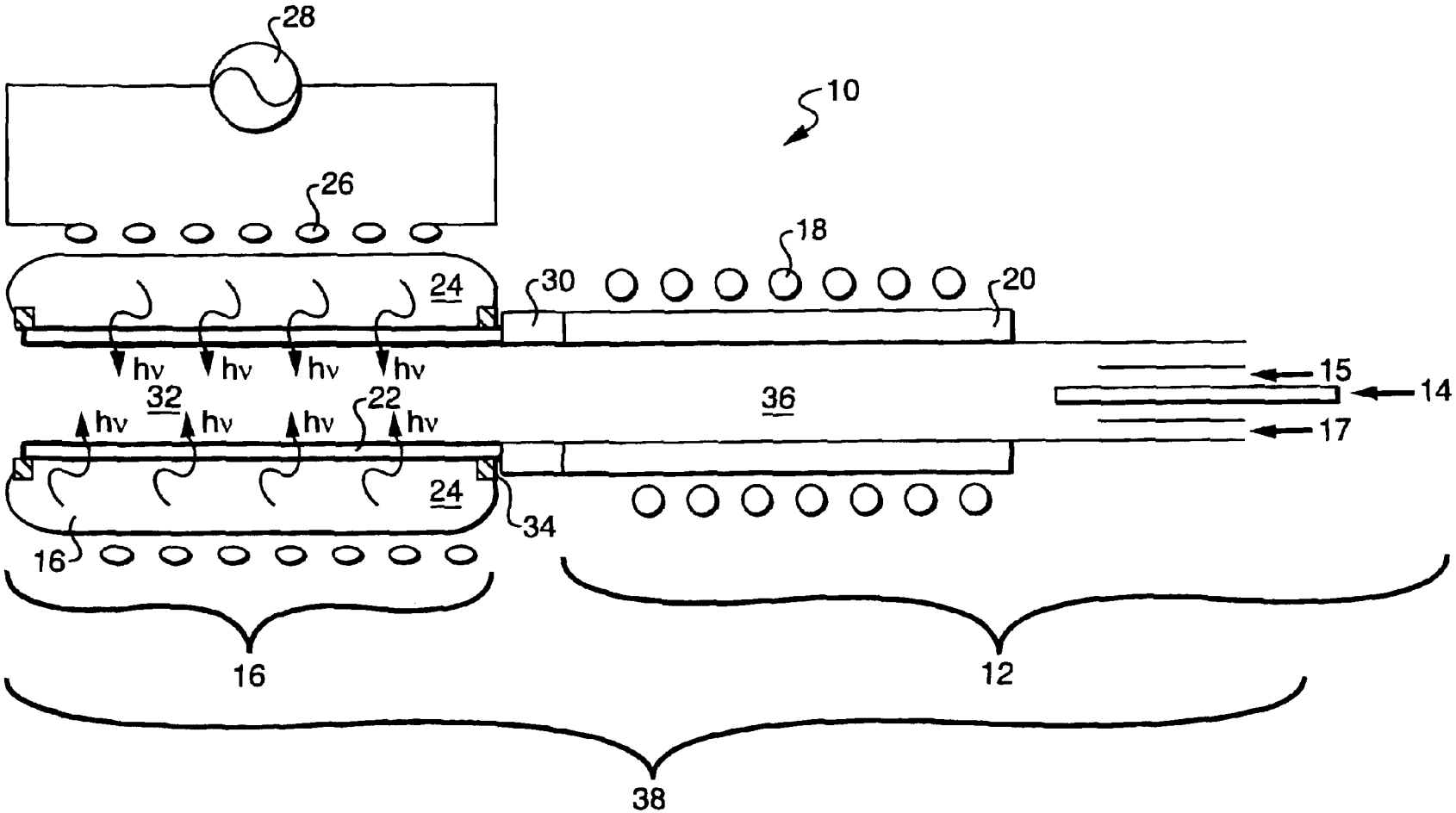
FIG. 2 depicts another embodiment of the present invention in which there is a coupler that facilitates the union of a nebulizer to a discharge lamp.

The present invention pertains to a photoionization source that arcs around a path that vapor will be following after being generated by a vapor source. An embodiment of this assembly is shown in FIGS. 1 and 2 where APPI source 10 comprises a coaxial discharge lamp 16 and a nebulizer 12 that could be used in a mass spectrometer. The coaxial discharge lamp of the figures illustrates a photoionization source utilizing a lamp that completes a 360° curve. The invention further includes lamps having an arc between about 90° through 360° with a preferred arc of 180° and an even more preferred arc of 360°. When implemented as illustrated, the coaxial discharge lamp 16 comprises an ultra-violet (UV) transparent tube 22 (included herein are vacuum-ultra-violet transparent tubes), a discharge lamp gas envelope 24, and a radio-frequency (Rf) discharge coil 26. Unlike the APPI sources disclosed in the prior art, the coaxial discharge lamp 16 of the present invention is circumferentially disposed about a longitudinal axis (La) forming a cavity passageway held at atmospheric pressure. A vapor source, represented in the figures as a heated nebulizer 12 is approximately aligned along the same longitudinal axis. The invention further includes utilizing more than one lamp subtending less than 360° combining the lamps radially and/or laterally to provide an enlarged photoionization zone.

FIG. 1 depicts one embodiment of the present invention, wherein a nebulizer 12 is in fluid communication with a coaxial discharge lamp 16. In this embodiment, a nebulizer tube 20, which defines the interior chamber 36 of the nebulizer 12, is not structurally connected to an UV transparent tube 22 of the discharge lamp 16. Rather, it is spatially disposed adjacent to the UV tube 22. In one aspect, the exit of the nebulizer tube 20 is aligned directly in front of the entrance of the discharge lamp 16. This orientation permits continuous direct constituent flow from the nebulizer tube 20 into the UV tube 22. Alternatively, the exit of the nebulizer tube 20 can be angled with respect to the entrance of the discharge lamp 16 allowing a portion of the nebulizer output to flow into the discharge lamp 16 and a portion, for instance unvaporized sample, to be excluded from the lamp 16. If the discharge lamp 16 is implemented as an arched passageway rather than the tube shown, the lamp and nebulizer can be aligned and still allow some of the vapor to be excluded from the photoionization zone. The nebulizer tube 20 can be comprised of quartz, ceramic, glass, fused silica, stainless steel, and alike.

In this embodiment, the nebulizer can be heated to temperatures ranging from about ambient temperature to about 800° C. via heating element 18. Therefore, the material composition of the nebulizer tube 20 must be able to withstand temperatures of up to 800° C. Alternate nebulizers 12 may be tailored to produce a temperature range from ambient to between 200 and 400° C. Such nebulizers can be composed of materials that are adapted to the reduced temperature range. Although the lamp 16 is displaced from the nebulizer 12 and will not have to withstand the same temperatures as the nebulizer 12, provisions may still be made to accommodate high temperatures. Less temperature hardened lamps could be useful with heated nebulizers that would require them to withstand a temperature of only, for example, about 200° C. to about 400° C. The uv transparent tube 22 of the discharge lamp 16 can comprise quartz, $MgF_2$, $CaF_2$, and LiF. In the embodiment of FIG. 1, a discharge lamp gas envelope 24 is disposed coaxially adjacent to the UV tube 22 and affixed to UV tube 22 by seals 34. This lamp envelope 24 can be comprised of quartz, borosilicate, glass, in particular, soda glass, or other grades of glass which can be easily shaped or extruded by those skilled in the art. Preferably, soda glass is used in combination with $MgF_2$ given that soda glass has a temperature expansion coefficient that is comparable to $MgF_2$. (Samson, J. A. R., "Techniques of Vacuum Ultraviolet Spectroscopy", Wiley: N.Y., 1967.) The lamp envelope 24 comprises one or more noble gases. When these gases are excited, they emit energy in the form of photons that interact with one or more analytes present in the interior chamber 32 resulting in the photoionization of one or more of these analytes.

The gas within the gas envelope 24 is excited by an electrical current carried and distributed by the Rf discharge coil 26. The excited gas emits photons of energy. These photons of energy ionize the analytes present within the interior chamber 32. The ionized molecules can then be quantitatively analyzed using a mass detector such as a scanning quadrupole mass detector (not shown).

FIG. 2 depicts another embodiment of the present invention, wherein a nebulizer 12 is coupled to a coaxial discharge lamp 16. More particularly, a nebulizer tube 20 is coupled to an UV transparent tube 22 of the discharge lamp 16 via a coupler 30. The coupler 30 typically withstands atmospheric pressure as well as temperatures in excess of between ambient temperature and 800° C. The material used to construct the coupler 30 must be strong enough and be heat resistant. Materials suitable for constructing the coupler 30 include, but are not limited to, quartz, ceramic, copper, stainless steel, glass, and fused silica. The manufacturing sequence of affixing the coupler 30 between the nebulizer tube 20 and the UV transparent tube 22 is irrelevant, i.e., the coupler 30 can be affixed first to either the nebulizer tube 20 or UV tube 22. Union of the coupler 30 to both the nebulizer tube 20 and UV tube 22 is performed by means well known in the art. In the illustrated embodiment, the coupler 30 can be simply affixed in place or placed inside the nebulizer tube 20. Regardless of the actual placement, the coupler 30 must be affixed to the coaxial photoionization lamp 16 so that the lamp 16 is suspended in front of the exit of the nebulizer tube 20. The tube 20 of the heated nebulizer is sufficient to guide the stream of effluent into the tube 22 of the photoionization lamp 16. It is important to have the internal diameter of the nebulizer tube 20 be less than or equal to the internal diameter of the tube 22 of the photoionization lamp 16, which typically ranges from 1 to 10 mm, so there is no problem of disrupting the flow (turbulent flow effects, etc.) of the gas from the nebulizer before it passes into the tube of the coaxial photoionization lamp 16.

Operationally, in the embodiments of both FIGS. 1 and 2 effluent containing the analyte, or analytes, of interest enters the nebulizer/discharge lamp assembly 38 via a liquid inlet 14. Along with the effluent, nebulizer gas 15 and auxiliary gas 17 enter the nebulizer 12. The effluent is heated from about ambient temperature to the target temperature by the nebulizer 12. In this invention, the heated nebulizer 12 operates under conditions of atmospheric pressure. As the effluent is propelled through the heated nebulizer 12 by the gasses 15 and 17, a fine mist of effluent-containing analyte is formed. The nebulizer treated effluent then passes into the discharge lamp 16 where the molecules are subjected to photoionization.

In making the coaxial lamp 16, the ultraviolet transparent tube 22 is sealed to the glass envelope 24 using a seal 34 in such a manner as to allow the glass envelope 24 to be evaculated to a low vacuum and then "back filled" with a noble gas of sufficient pressure for photon emission when the appropriate energy is applied to the Rf coil. This can be accomplished using a "side arm" port (not shown) incorporated into the glass envelope 24, such as that described by Mark Eugene Homan in his doctoral dissertation entitled, "A Krypton VUV Photoionization Source For Gas Chromatography And Mass Spectrometry," written while at The University of Arizona in 1990; the entire teaching of which is incorporated herein by reference.

Alternatively, a "side arm" port on the glass envelope 24 could be connected to a system consisting of a three-way valve, a rough vacuum line, and a regulated noble gas supply, so that different pressures could be readily achieved. A pressure sensor (not shown) in-line with the envelope 24 would act to monitor pressure inside the envelope 24. However, while such a system would be required to initially charge the lamp 16 with the appropriate noble gas (or gases) pressure, the side arm would be sealed and the discharge lamp 16 removed from the charging system for operational uses. The seal 34 between the ultraviolet transparent tube 22 and the glass envelope 24 is designed so that the noble gas is contained inside the envelope 24 (i.e., does not leak out). In addition, the mechanical seal 34 between the UV transparent tube 22 and glass envelope 24 is designed so that the lamp can withstand the mechanical stress associated with operation near the elevated operating temperatures of a heated nebulizer.

The UV tube 22 is comprised of material that facilitates the transmission of light energy from the discharge lamp gas envelope 24 to an interior chamber 32 of the APPI source. Materials used to construct the UV tube 22 include, but are not limited to, $MgF_2$, $CaF_2$, and LiF. In one embodiment, the UV tube 22 is constructed using $MgF_2$, such as that described in the Homan dissertation.

The discharge lamp gas envelope 24 is disposed as a cylinder concentric with the UV transparent tube 22. In one aspect, the gas envelope 24 makes physical contact and is bonded to the UV transparent tube 22. In another aspect, described below, a glass or quartz tube (not shown) and the UV transparent tube 22 are joined together to form a gas-tight assemblage. The gas envelope 24 holds one or more noble gases, such as He, Ar, Ne, Xe, and Kr between the glass tube and the UV transparent tube 22. This gas envelope 24 can be made to the desired length, usually between 1 and 12 cm, for the purpose of maximizing UV photon interaction with an analyte as it passes through the interior chamber 32 of the APPI source 10. Alternately, one or more discharge lamps may be laterally aligned to form a sufficiently long photoionization zone. Materials used to construct the gas envelope 24 and the glass tube include, but are not limited to, glass (all grades like soda glass, etc.), fused silica, borosilicate, or quartz.

Figure 3:
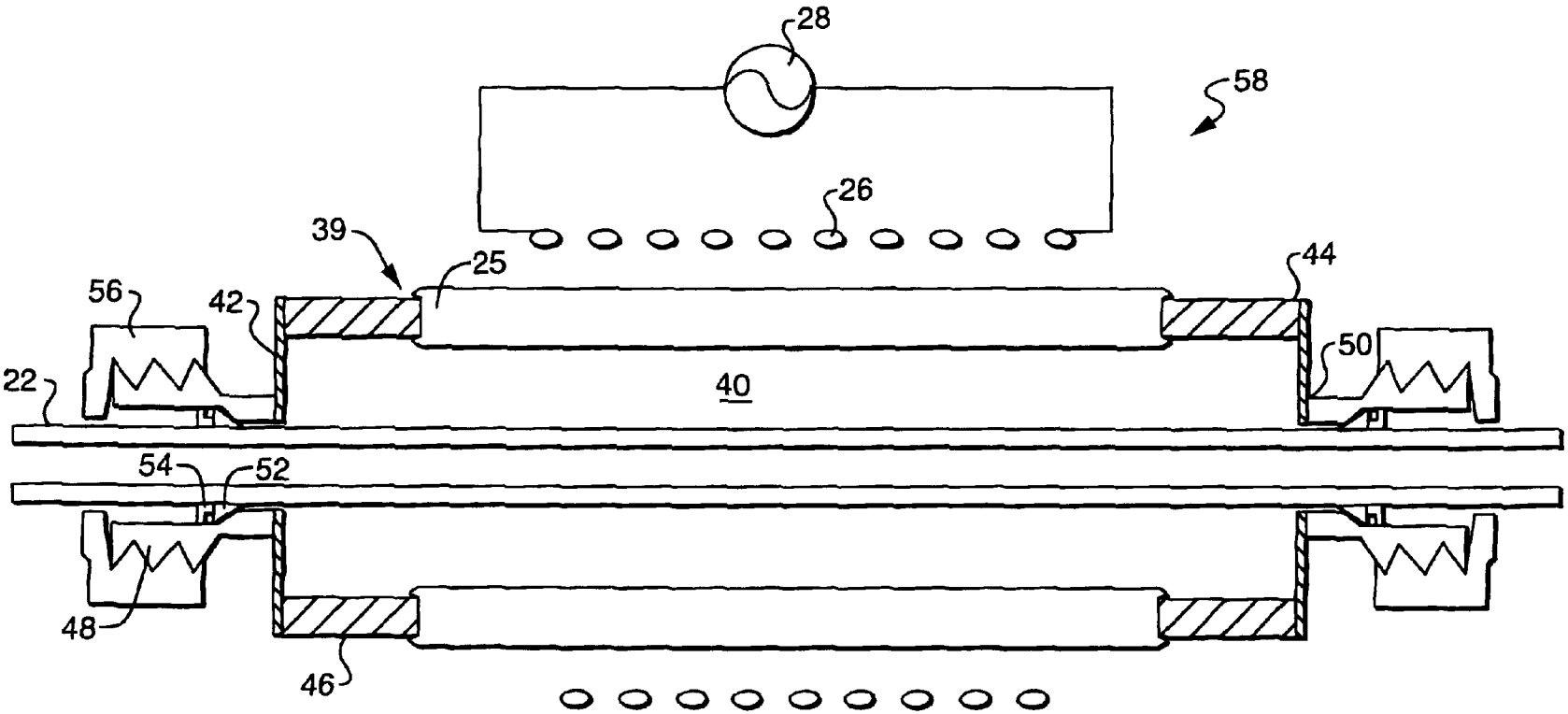
FIG. 3 depicts a means of fabricating the lamp of the invention.

In an embodiment that will be exposed to high temperatures, a coaxial APPI lamp is constructed with an assembly replacing the glass envelope 24. The assembly 58, as shown in FIG. 3, is constructed from a glass or quartz tube 25 and an ultra-violet tube 22 arranged concentrically with seals between them tailored for thermal resiliency. The seals contain metal fittings on each end. The outer skin of the envelope 40 for containing the noble gas is constructed from a glass or quartz tube 25 with metal tubes 46 (stainless steel in one particular embodiment) sealed at each end with a glass-to-metal Kovar™ seal 39. The process of fabricating such an envelope 40 is well known to those skilled in the art. To each end of the metal tubing 46, a thin-walled metal disk 42 with a hole in the middle, (or, alternatively, a bellows) is attached. The joints 44 are silver soldered or brazed to seal the disk 42 to the end of the tube 46. A Swagelok™ fitting (stainless steel or equivalent) 48 is then placed abutting each disk 42 and joint 50 is silver soldered or brazed to seal the fitting 48 to the disk 42 The UV transparent tube 22 is placed through the center of the Swagelok™ fittings 48 which contain a front ferrule 52, back ferrule 54 and a nut 56. The front ferrule 52 and back ferrule 54 in this embodiment are made of a soft metal such as copper. The UV transparent tube 22 is then sealed in place by tightening the nut 56 against the front ferrule 52 and back ferrule 54. Using a soft metal, such as copper, for the ferrules allows the lamp to withstand high temperatures and keep the noble gas sealed within the lamp assembly at the proper pressure. The use of thin metal disks 42 (or bellows) at the ends of the assembly compensates for any differences in thermal expansion of the UV transparent tube 22 and the surrounding glass (or quartz) tube 25 that form the envelope 40. Therefore, the lamp can be coupled to a heated nebulizer, subjecting it to high temperatures, without damage to the lamp assembly. It may be necessary to "shield" any conductive components associated with the assembly of FIG. 3 from the Rf load coil 26 by, for instance, coating the metal ends with a non-conducting material.

In one embodiment, a radio-frequency discharge coil 26 is disposed about the discharge lamp 16, 58. Physical contact may be made between the discharge coil 26 and the external surface of the gas envelope 24, 40. The discharge coil 26 of the present invention utilizes sufficient electrical current of about 350 milliamperes to impart energy to the gas envelope 24, 40 such that the excitation of the gas (or gases) contained therein will occur. Depending upon the gas employed, the pressure, and the Rf frequency, the excited gas in the lamp 16 will generate photon energy (hv) on the order of 7–15 eV, which is sufficient to ionize most organic molecules without resulting in significant fragmentation. As illustrated in FIGS. 1 and 2, the discharge coil 26 is in electrical communication with a Rf generator 28 that supplies the discharge coil 26 with an electrical current. The generator supplies high frequency energy from, for example, the radio, short wave or microwave regions of the electromagnetic spectrum.

In embodiments of the present invention the vapor source incorporates, one or more heating elements 18, such as a heating coil, to provide a nebulizer 12 with sufficient heat energy to facilitate the nebulizer 12 reaching temperatures between about ambient temperature to about 800° C. Other examples of a heating element include, but are not limited to, a ceramic cartridge heater. The higher temperatures in this range facilitate desolvation of the HPLC eluent from the aerosol spray of the nebulizer providing a vapor with fewer stray absorbent molecules.

In the present invention, the discharge lamp 16 and nebulizer 12 can be associated with a liquid chromatography (LC) apparatus (not shown). Liquid chromatography is a widely used separation technique that relies on the differential adsorption properties of molecules. Typically an organic mixture in a specific solvent is added to the top of a tubular column which has been packed with a fixed bed of adsorbent material (the stationary phase) providing a surface area onto which substances may be adsorbed. Alternatively, a sample containing an organic mixture is injected into a high pressure liquid chromatography (HPLC) apparatus that has a HPLC column attached thereto. High pressure pumps in the HPLC apparatus deliver solvent (the mobile phase) and solute through the column. In the atmospheric pressure LC setup, gravity or peristaltic pumps can be employed to propel the solute and solvent through the column. As the solvent-solute mixture passes through the column, some solute molecules may be adsorbed onto the column allowing less adsorbable solute molecules to pass through and exit the column. Ideally, a heterogeneous sample of solute molecules will be progressively separated into components as it traverses the column. As the solute molecules egress from the column, a differential retention pattern separates the various components of the solute allowing for a qualitative characterization of the components contained within the starting sample mixture.

Once chromatographically separated, an individual solute (or analyte) can be analyzed by, for example, mass spectroscopy. In the present invention, the effluent from the LC apparatus enters the heated nebulizer 12, which is under atmospheric pressure, through a liquid inlet 14. From the heated nebulizer 12, a vapor containing analytes along with any remaining solvent enter into the coaxial discharge lamp 16 region of the mass spectrometer. These analytes are subject to photoionization by the coaxial discharge lamp 16. The ionized molecules then travel to and interact with a mass detector, e.g., a quadrupole mass detector. One advantage of using APPI as opposed to, for example, APCI, is the increased sensitivity exhibited using APPI at flow rates below 200 $\mu$L/min.

The coaxial radio-frequency lamp design 16 of the present invention, either directly affixed to or coupled with the heated nebulizer 12, offers significant advantages over the prior art such as increasing photon flux which results in an increase in photoionization efficiency. A larger photoionization interaction zone with the effluent from the heated nebulizer 12 is also a favorable consequence of the instant invention. One of the significant benefits of an increase in photon flux is that dampening effect of absorption of the UV radiation by solvents such as acetonitrile is mitigated. This obviously allows a practitioner to employ a commonly used chromatography solvent like acetonitrile in their protocols. Additionally, no dopant is required in this coaxial APPI system of the present invention, although a dopant could be used if so desired. Moreover, the coaxial design of the APPI source of the instant invention allows photons from the discharge lamp 16 to penetrate the vaporized analyte from all sides. This has a positive influence on photoionization efficiency. Since photon flux is related to the distance from the source of photons, photon flux is expected to be much greater due to the proximity of the photon source to the analyte molecules flowing in the interior chamber 32.

One skilled in the art will appreciate further features and advantages of the invention based on the above-described embodiments. Accordingly, the invention is not to be limited by what has been particularly shown and described, except as indicated by the appended claims.

What is claimed is:

1. A photoionization source comprising:

(a) a source of vapor of one or more compounds of interest, said vapor traveling in a path defining an axis toward an inlet; and (b) a lamp for emitting photons into said vapor path, said lamp having a photon emitting region disposed at a radius along a said axis and in communication with said source of vapor such that said photons are emitted into said vapor traveling on said path to produce ionization of said compounds, wherein a centerline of a vapor pattern from the source is oriented at an angle with respect to said axis of said vapor path such that when the vapor pattern enters the photon emitting region of the lamp said photons are emitted into only a portion of the vapor.

2. The photoionization source of claim 1 wherein said one or more compounds of interest are sourced by an in-line liquid chromatography apparatus.

3. The photoionization source of claim 1 wherein said photon emitting region subtends an arc of between 90 and 360 degrees about a source axis.

4. The photoionization source of claim 3 wherein said photon emitting region encompasses 360 degrees about said source axis.

5. The photoionization source of claim 1 wherein said axis of said vapor path and a centerline of a vapor pattern are approximately aligned.

6. The photoionization source of claim 5 wherein said source of vapor is connected to said lamp for emitting photons.

7. The photoionization source of claim 1 wherein said source of vapor is a nebulizer.

8. The photoionization source of claim 7 wherein said nebulizer operates at atmospheric pressure.

9. The photoionization source of claim 7 wherein said nebulizer has one or more heating elements capable of heating said nebulizer from about ambient temperature to about 800° C.

10. The photoionization source of claim 9 wherein said nebulizer has a nebulizer tube.

11. The photoionization source of claim 10 wherein said nebulizer tube comprises material selected from the group consisting of quartz, ceramic, fused silica, glass, and stainless steel.

12. The photoionization source of claim 1 wherein said lamp is a discharge lamp.

13. The photoionization source of claim 12 wherein said lamp contains one or more noble gases, said gases capable of emitting photons when excited.

14. The photoionization source of claim 13 wherein said excited gases emit photons on the order of from about 7 eV to about 15 eV.

15. The photoionization source of claim 13 wherein said discharge lamp comprises:

(a) an ultra-violet transparent tube;

(b) a discharge lamp envelope that is sealed to said ultra-violet transparent tube, wherein said lamp envelope contains one or more gases; and (c) a Rf discharge coil that is disposed adjacent and external to said discharge lamp envelope, wherein said discharge coil provides sufficient electrical energy to said gases within said discharge lamp envelope to excite said gases to emit photons.

16. The photoionization source of claim 15 wherein, said ultra-violet transparent tube comprises material selected from the group consisting of quartz, $MgF_2$, $CaF_2$, and LiF.

17. The photoionization source of claim 15 wherein the material to construct said discharge lamp envelope is selected from the group consisting of glass, soda glass, borosilicate and quartz.

18. The photoionization source of claim 15 wherein said Rf discharge coil is in electrical communication with a Rf generator.

19. The photoionization source of claim 16, wherein said noble gas is selected from the group consisting of He, Ar, Ne, Xe, Kr, and a combination thereof.

20. A mass spectrometer comprising:

(a) a nebulizer for outputting a vapor of one or more compounds of interest, said vapor traveling in a path defining an axis toward an inlet;

(b) a lamp for emitting photons into said vapor path coupled to said nebulizer; and (c) a coupler that facilitates said coupling of said nebulizer to said lamp, wherein a centerline of a vapor pattern from the source is oriented at an angle with respect to said axis of said vapor path such that when the vapor pattern enters the photon emitting region of the lame said photons are emitted into only a portion of the vapor.

21. The mass spectrometer of claim 20 wherein said coupler comprises material selected from the group consisting of glass, fused silica, quartz, ceramic, copper, stainless steel, and combinations thereof.

22. The mass spectrometer of claim 20 wherein said nebulizer further comprises at least one heating element for heating said nebulizer to temperatures between about ambient and about 800° C.; said nebulizer operates at atmospheric pressure.

23. The mass spectrometer of claim 20 wherein said lamp has a photon emitting region disposed at a radius along said axis such that said photons are emitted into said vapor traveling on said path to produce ionization of said compounds.

24. The mass spectrometer of claim 23 wherein said photon emitting region is an ultra-violet transparent region.

25. The mass spectrometer of claim 20 wherein said lamp is charged with one or more noble gases, said gases capable of emitting photons when excited.

26. The mass spectrometer of claim 20 further comprising an in-line liquid chromatography apparatus connected to an input of said nebulizer.

27. The mass spectrometer of claim 20 wherein said inlet communicates with a mass detector.

28. The mass spectrometer of claim 20 wherein said coaxial discharge lamp is charged with at least one noble gas and wherein said at least one noble gas emits photons upon excitation.

29. A mass spectrometer comprising:

an in-line liquid chromatography apparatus;

a nebulizer operating under atmospheric pressure comprising at least one heating element for heating said nebulizer to temperatures between ambient and 800° C., said nebulizer disposed to receive the output of said in-line liquid chromatography apparatus;

a coaxial discharge lamp disposed in communication with said nebulizer to enable a nebulizer output to pass through said coaxial discharge lamp; and a mass detector disposed to detect an output of said coaxial discharge lamp, wherein a central axis of said coaxial discharge lamp is at an angle with respect to a central axis of said nebulizer such that when a vapor pattern enters a photon emitting region of the lamp said photons are emitted into only a portion of the vapor.

30. The mass spectrometer of claim 29 wherein said excited gases emit photons on the order of from about 7 eV to about 15 eV.

31. The mass spectrometer of claim 29 wherein said coaxial discharge lamp and said nebulizer are approximately aligned along a central axis.

* * * * *